US011103736B2

(12) United States Patent
Svendsen

(10) Patent No.: US 11,103,736 B2
(45) Date of Patent: Aug. 31, 2021

(54) STARTING PLATFORM WITH INTEGRATED BACKSTROKE ANCHOR LEDGE

(71) Applicant: S.R. Smith, LLC, Canby, OR (US)

(72) Inventor: William J Svendsen, Canby, OR (US)

(73) Assignee: S.R. SMITH, LLC, Canby, OR (US)

( * ) Notice: Subject to any disclaimer, the term of this patent is extended or adjusted under 35 U.S.C. 154(b) by 72 days.

(21) Appl. No.: 16/714,342

(22) Filed: Dec. 13, 2019

(65) Prior Publication Data

US 2020/0197738 A1 Jun. 25, 2020

Related U.S. Application Data

(60) Provisional application No. 62/784,271, filed on Dec. 21, 2018.

(51) Int. Cl.
*A63B 5/10* (2006.01)

(52) U.S. Cl.
CPC ..... *A63B 5/10* (2013.01); *A63B 2244/20* (2013.01)

(58) Field of Classification Search
CPC .. A63B 5/10; A63B 2244/20; A63B 2244/203
See application file for complete search history.

(56) References Cited

U.S. PATENT DOCUMENTS 4,134,583 A * 1/1979 Davidson ..... A63K 3/023 472/85
5,938,565 A 8/1999 Bernacki
D509,277 S * 9/2005 Morral Gispert ..... A63B 5/10 D21/802
7,058,994 B2 6/2006 Weimer et al.
8,986,173 B1 * 3/2015 Adams ..... A63B 21/0557 482/106
9,421,407 B2 * 8/2016 Collette ..... A63K 3/023
10,245,524 B2 * 4/2019 Stockinger ..... A63K 3/02
2004/0058789 A1 * 3/2004 Tsai ..... A63B 23/03541 482/115
2010/0233664 A1 * 9/2010 Wroclawsky ..... A63B 21/4009 434/247

(Continued)

FOREIGN PATENT DOCUMENTS

CN 207722273 U 8/2018
EP 2740518 A2 6/2014

(Continued)

OTHER PUBLICATIONS

European Patent Office, Extended European Search Report for Application No. 19218855.5, dated Apr. 21, 2020, 11 pages.

(Continued)

*Primary Examiner* — Nyca T Nguyen
(74) *Attorney, Agent, or Firm* — Stoel Rives LLP

(57) ABSTRACT

A swimming starting platform having a base supporting a tread surface and an anchor ledge for supporting swimmers. The base includes a shaft extending through an interior cavity of the base from a first side panel to a second side panel. An adjustment mechanism is coupled to an end of the shaft and positioned along the first side panel, where the adjustment mechanism is actuatable to rotate the shaft and adjust a position of the anchor ledge relative to the base of the starting platform.

20 Claims, 5 Drawing Sheets

(56) References Cited

U.S. PATENT DOCUMENTS

| | | | | |
|---|---|---|---|---|
| 2015/0290553 | A1* | 10/2015 | Stockinger | A63B 31/00 4/496 |
| 2016/0256721 | A1* | 9/2016 | Abe | A63B 5/10 |
| 2018/0214731 | A1* | 8/2018 | Sherin | A63B 21/00065 |
| 2019/0099649 | A1* | 4/2019 | Machovina | A63B 69/06 |
| 2020/0030660 | A1* | 1/2020 | Herring | A63B 21/156 |

FOREIGN PATENT DOCUMENTS

| | | | |
|---|---|---|---|
| EP | 2740518 | A3 | 5/2016 |
| WO | 2015016872 | A1 | 2/2015 |

OTHER PUBLICATIONS

Fina, Omega Backstroke Start Device, https://www.youtube.com/watch?v=63C-zMOCAB0, Mar. 20, 2014, entire video.

* cited by examiner

STARTING PLATFORM WITH INTEGRATED BACKSTROKE ANCHOR LEDGE

RELATED APPLICATION DATA

This application is a nonprovisional of and claims the benefit under 35 U.S.C. § 119(e) of U.S. Provisional Patent Application No. 62/784,271, filed Dec. 21, 2018, the disclosure of which is incorporated by reference herein in its entirety.

TECHNICAL FIELD

The field of the present disclosure relates generally to starting platforms for swimmers, and in particular, to such platforms incorporating an anchor ledge with an adjustment assembly for adjusting a position of the anchor ledge when desired.

BACKGROUND

Starting platforms for swimmers are well-known in the industry. For backstroke swimmers, various platform designs have been employed to provide anchor ledges for supporting a swimmer's feet and providing proper purchase as the swimmer prepares to push off prior to commencing the stroke. Many such conventional platforms provide a fixed anchor ledge that cannot be adjusted to suit a swimmer's needs. Accordingly, swimmers are not able to alter the position of the anchor ledge for their individual comfort. Other arrangements for adjustable anchor ledges include standalone systems designed to be supported by and removably affixable to the existing starting platform.

The present inventor has recognized various disadvantages of such standalone designs. For example, such anchor ledge systems are typically installed over the top surface of an existing starting platform where a swimmer would ordinarily stand when jumping into the pool. In some instances, such as during a medley race featuring multiple swimming disciplines, this conventional design requires the system to be installed prior to a backstroke swimmer beginning a race and thereafter removed for a subsequent swimmer to avoid creating potential tripping hazards or injuries for the swimmers. Another disadvantage is that by design, the system must be removed and reinstalled repeatedly on a starting platform, thereby increasing the likelihood of improper installation occurring at some point, which may lead to the ledge being unstable for the swimmer.

Accordingly, the present inventor has determined that it would be desirable to design a starting platform with an integrated adjustable backstroke anchor ledge that is secure and easy to use. In addition, the present inventor has determined that it would be desirable to have such a platform design that can be used for all swimming events without requiring removal of the anchor ledge system. Additional aspects and advantages of such a starting platform design will be apparent from the following detailed description of example embodiments, which proceed with reference to the accompanying drawings.

Understanding that the drawings depict only certain embodiments and are not, therefore, to be considered limiting in nature, these embodiments will be described and explained with additional specificity and detail with reference to the drawings.

DETAILED DESCRIPTION OF EXAMPLE EMBODIMENTS

Figure 1:
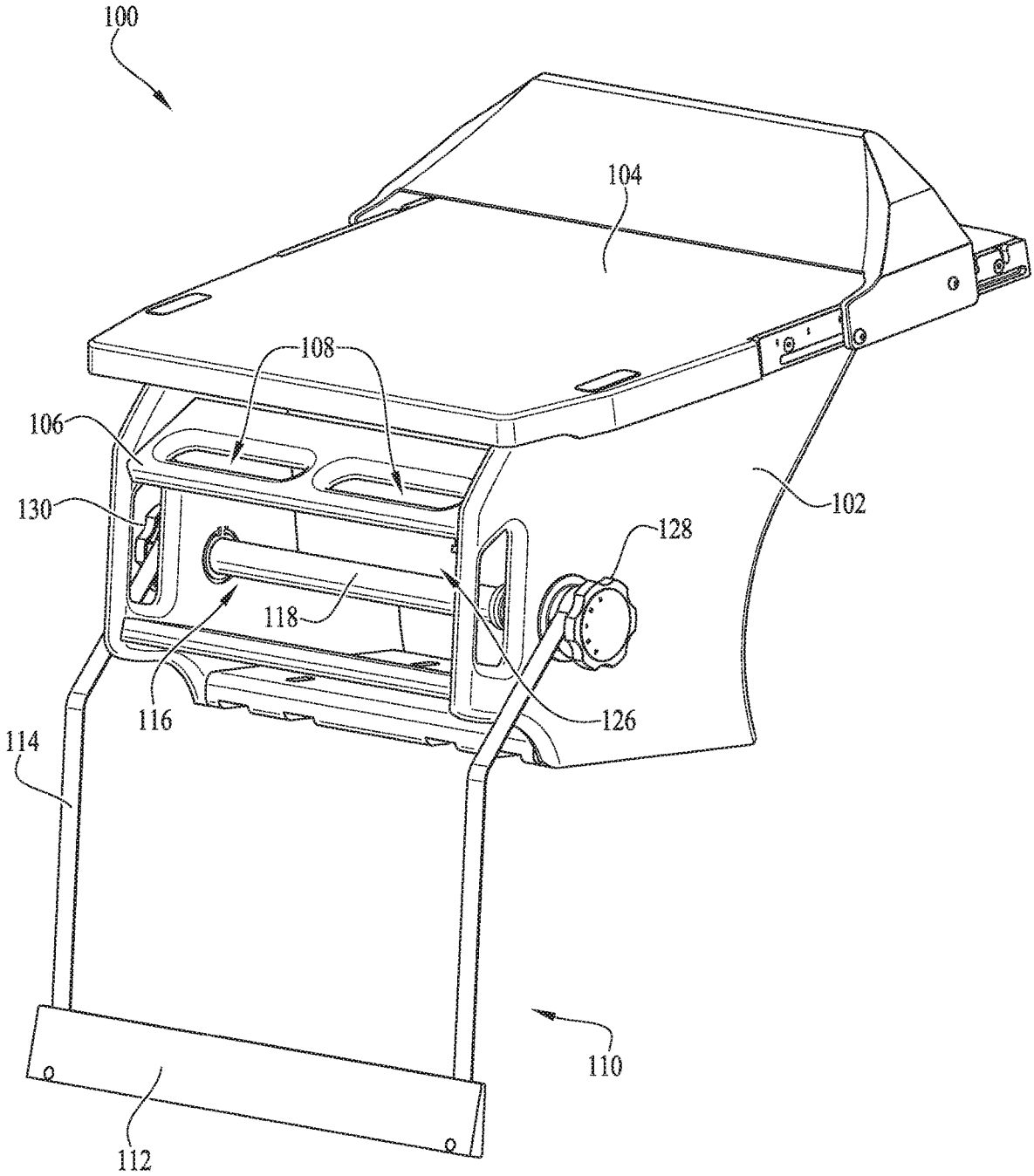
FIGS. 1 and 2 are perspective views of a starting platform with an integrated anchor ledge in accordance with one example embodiment.

With reference to the drawings, this section describes embodiments of a starting platform for swimmers and its detailed construction and operation. Throughout the specification, reference to "one embodiment," "an embodiment," or "some embodiments" means that a described feature, structure, or characteristic may be included in at least one embodiment of the starting platform being discussed. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In the following description, certain components of the starting platform are described in detail. It should be understood that in some instances, well-known structures, materials, or operations are not shown or not described in detail to avoid obscuring pertinent aspects of the embodiments.

FIGS. 1-6 collectively illustrate various details and embodiments of a starting platform 100 designed for use in commercial pools, training facilities, residential pools, or other similar environments. The starting platform 100 includes a stand or base 102 supporting a tread surface 104 along a top portion of the base 102. The tread surface 104 is made of any suitable material having anti-slip characteristics to provide grip and traction to a swimmer walking across the tread surface 104 in preparation for jumping into a pool. The starting platform 100 further includes an anchor ledge assembly 110 including an anchor ledge 112 extending downwardly relative to the base 102 of the starting platform 100, where the anchor ledge 112 is designed to extend into the water to support a swimmer's feet in the pool.

Briefly, the anchor ledge assembly 110 includes a shaft assembly 116 (or shaft assembly 216) incorporated into the base 102 of the starting platform 100 within an interior cavity 126 thereof, the shaft assembly 116 (or shaft assembly 216) being actuatable via an adjustment mechanism 128 to adjust a position of the anchor ledge 112 for individual swimmers. The adjustment mechanism 128 is preferably positioned such that it is easily and comfortably reachable by a swimmer while in the water prior to commencing the backstroke. As illustrated in the figures, the anchor ledge assembly 110 is integrated into the base 102 of the starting platform 100. As such, the anchor ledge assembly 110 does not encumber other swimmers using the tread surface 104 for a standing start, thereby allowing the anchor ledge assembly 110 to remain coupled to the starting platform 100 at all times. With reference to the figures, the following provides additional details of these and other embodiments of the starting platform 100 and its components.

Figure 2:
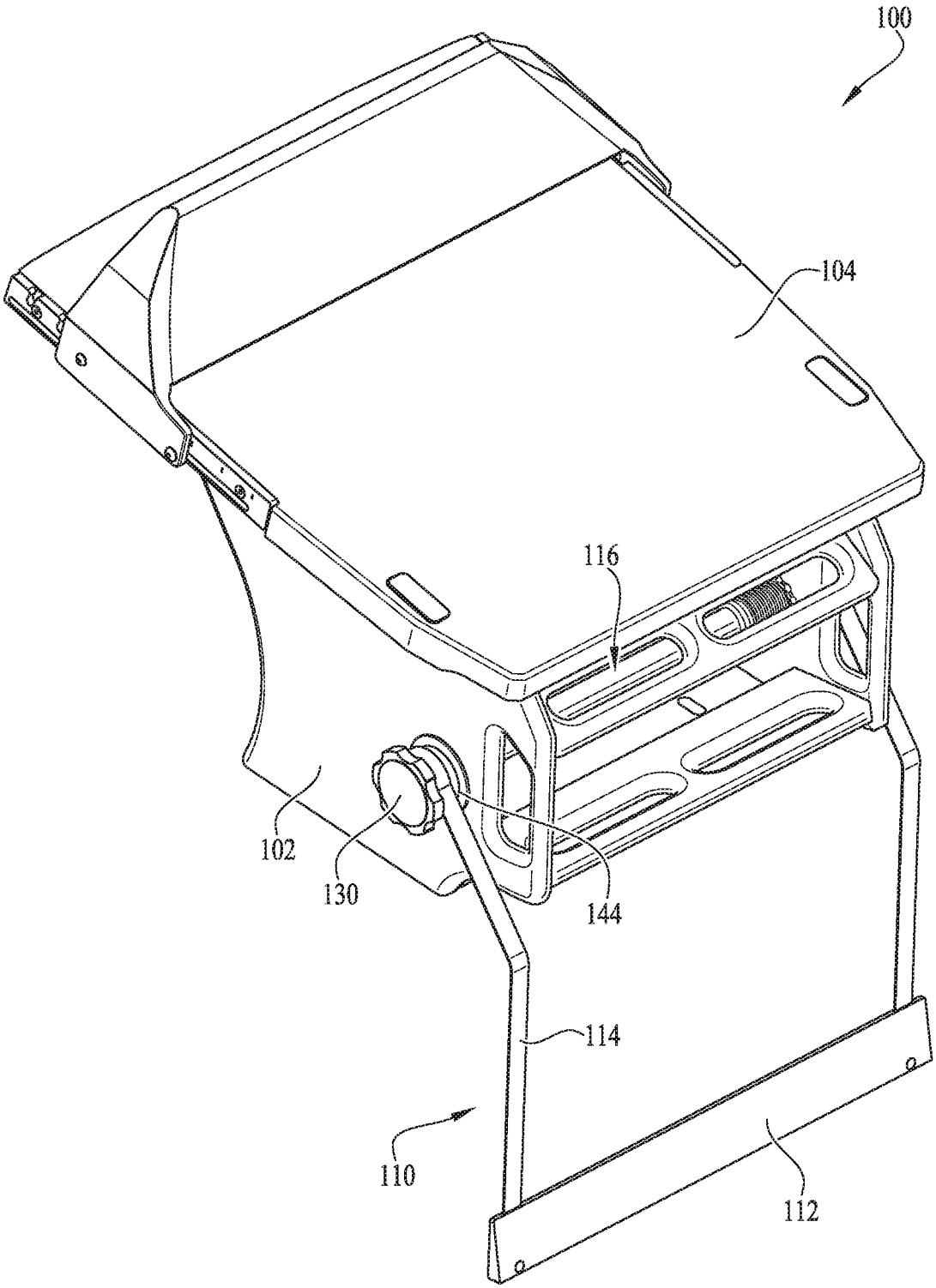

FIGS. 1 and 2 are perspective views of a starting platform 100 including an integrated anchor ledge assembly 110 operable to adjust a position of an anchor ledge 112 in accordance with one example embodiment. With reference to FIG. 1, the starting platform 100 includes a base 102 mountable to a flooring or other suitable surface surrounding a pool (not shown). The base 102 supports a tread surface 104 along a top portion of the base 102 and further includes a first side panel 138 and a second side panel 140 (see FIG. 3). In some embodiments, the tread surface 104 may be sloped slightly downwardly toward the surface of the water to facilitate a swimmer's jump into the pool. Preferably, the tread surface 104 is made of any suitable material with anti-slip features to provide sufficient grip to a swimmer walking on the tread surface 104 and jumping into the pool. The tread surface 104, and side panels 138, 140 surround an interior cavity 126 formed within the base 102. In some embodiments, the base 102 may include a front wall (not shown) to entirely enclose the cavity 126 and protect the interior components of the anchor ledge assembly 110.

Figure 3:
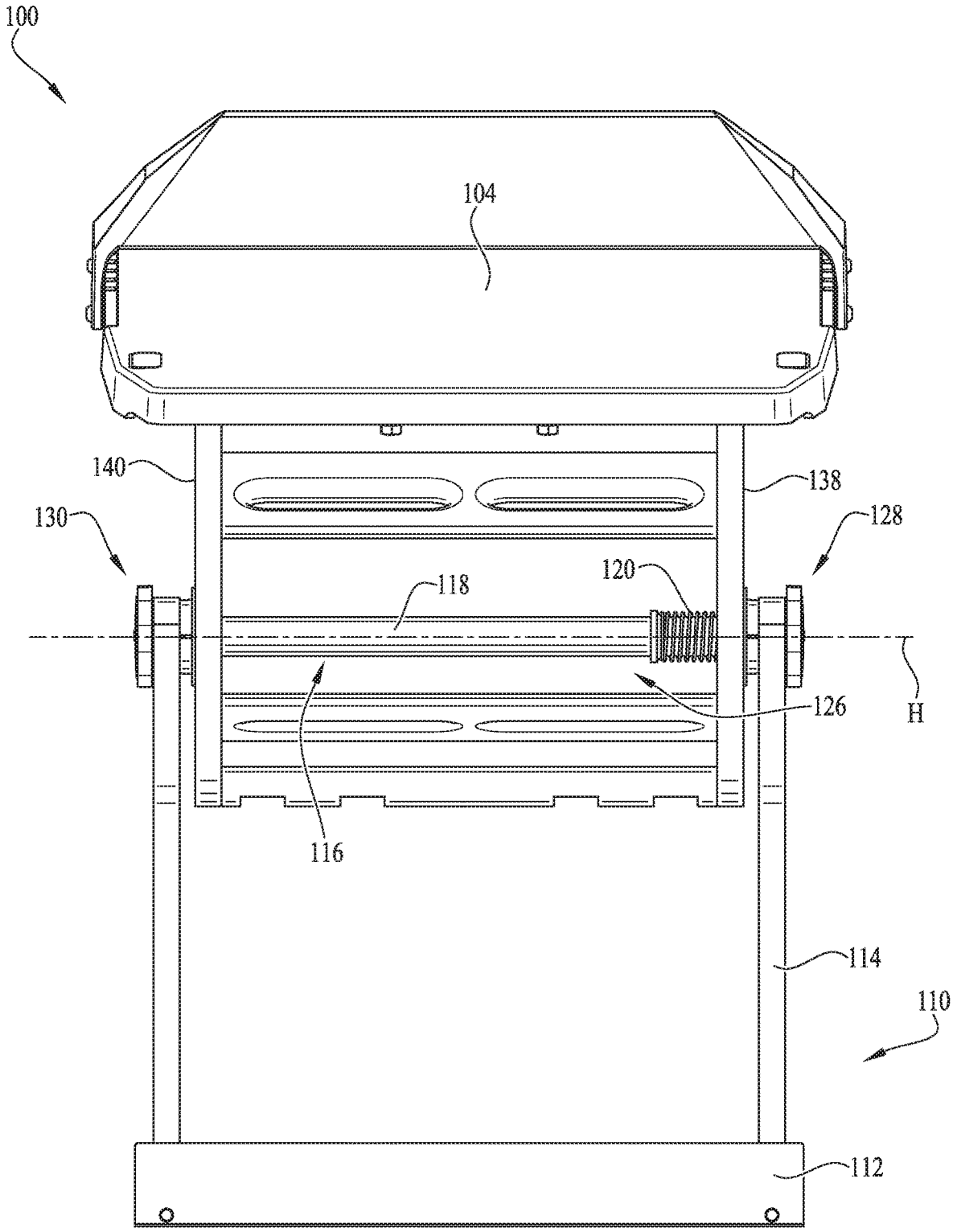
FIG. 3 is a front elevation view of the starting platform of FIG. 1.
Figure 4:
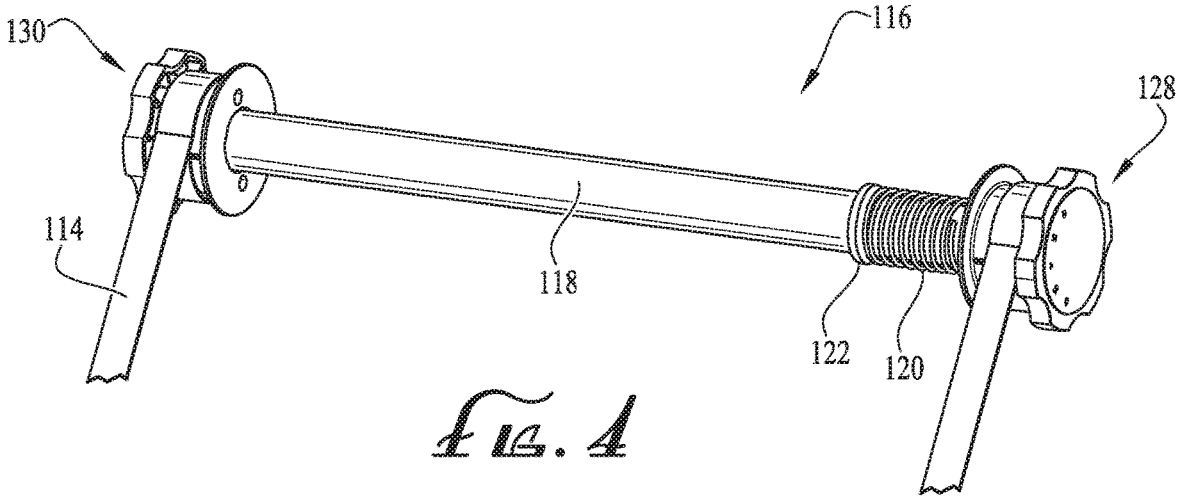
FIG. 4 is an enlarged view of a shaft assembly of the starting platform of FIGS. 1-3.

As illustrated in FIG. 1, the base 102 also includes a grip bar 106 including a pair of handgrips 108 (or other suitable grip mounts) to provide a handle for the swimmer to hold prior to pushing off for the start of a backstroke. The starting platform 100 further includes an anchor ledge assembly 110 incorporated into and supported by the base 102. The anchor ledge assembly 110 includes an anchor ledge 112 supported by a pair of lines 114, which may include ropes, straps, webbing, or other suitable material. As illustrated in FIGS. 1-2, each line 114 is supported along one of the side panels 138, 140 of the base 102 and coupled to a shaft 118 via an adjustment mechanism 128, 130. Preferably, the anchor ledge 112 is generally wedge-shaped to provide sufficient purchase for a swimmer's feet and to sit flush against a side wall (not shown) of the pool during use. The lines 114 couple the anchor ledge 112 to the shaft assembly 116 which is operable to adjust a position of the anchor ledge 112 as further described below. With particular reference to FIGS. 3-4, the following provides additional details of the shaft assembly 116 and its components, and further provides details of an example operation process for adjusting a position of the anchor ledge 112 in accordance with example embodiments.

FIG. 3 is a front elevation view of the starting platform 100 described previously, and FIG. 4 is an enlarged view of the shaft assembly 116 in accordance with one embodiment. With reference to FIG. 3, the shaft assembly 116 includes an elongated, generally tubular shaft 118 disposed within the interior cavity 126 of the base 102, the shaft 118 extending horizontally across the base 102 of the starting platform 100 from the first side panel 138 to the second side panel 140 as denoted by the axis H. The shaft 118 extends through openings (not shown) formed on the side panels 138, 140 of the base 102. With reference to FIG. 3, the shaft assembly 116 is offset from and positioned underneath the tread surface 104 of the base 102.

Turning to FIG. 4, the shaft 118 supports a compression spring 120 and one or more bellows 122. A first adjustment mechanism 128 (such as a knob or handle) is coupled to an end of the shaft 118 along an exterior surface of the first side panel 138. Similarly, a second adjustment mechanism 130 (such as a knob or handle) is coupled to the opposite end of the shaft 118 along an exterior surface of the second side panel 140. The adjustment mechanisms 128, 130 are keyed to the shaft 118 for rotation therewith, wherein the first adjustment mechanism 128 is operable to rotate both the shaft 118 and the second adjustment mechanism 130 as further described in detail below. As illustrated in FIGS. 1-3, the adjustment mechanisms 128, 130 sit flush against the respective side panels 138, 140 of the base 102 during a standard use configuration when no adjustments are being made.

Figure 5:
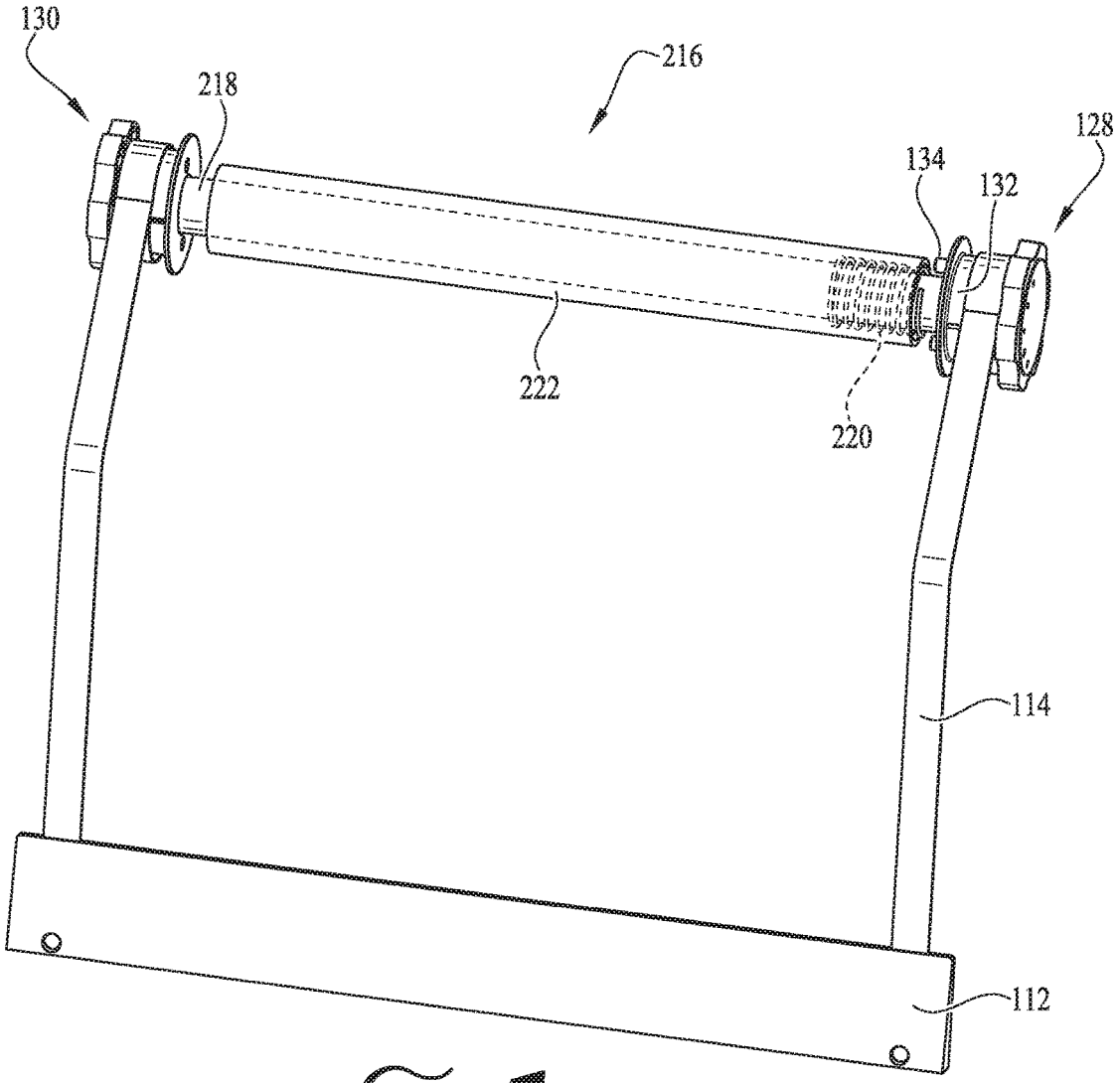
FIG. 5 is a partially exploded view of another embodiment of the shaft assembly of the starting platform of FIG. 1.

FIG. 5 illustrates another embodiment of a shaft assembly 216 that may be used in conjunction with the starting platform 100, where the shaft assembly 216 includes many of the same components operating in the same fashion as the shaft assembly 116. Accordingly, such components may not be further described in detail below with the understanding that the previous description applies to the embodiment of the shaft assembly 216 illustrated in FIG. 5.

Briefly, the shaft assembly 216 includes an elongated, generally tubular shaft 218 disposed within the interior cavity 126 of the base 102, the shaft 218 extending horizontally across the base 102 of the starting platform 100 from the first side panel 138 to the second side panel 140 in a similar fashion as described previously with reference to shaft assembly 116. The shaft 218 extends through openings (not shown) formed on the side panels 138, 140 of the base 102. The shaft assembly 216 supports a compression spring 220 and supports the adjustment mechanisms 128, 130 for operation in a similar fashion as described previously with reference to the shaft assembly 116. The shaft assembly 216 includes a tube 222 (which avoids the need to use bellows 122) extending around the tubular shaft 218 and the compression spring 220, the tube 222 extending along the length of the shaft 218 between the side panels 138, 140. Additional details regarding operation of the shaft assembly 216 are provided below. As further described below with collective reference to FIGS. 1-6, the shaft assembly 116 (or the shaft assembly 216) and adjustment mechanisms 128, 130 cooperate to facilitate fine adjustments of the anchor ledge 112 when needed.

Figure 6:
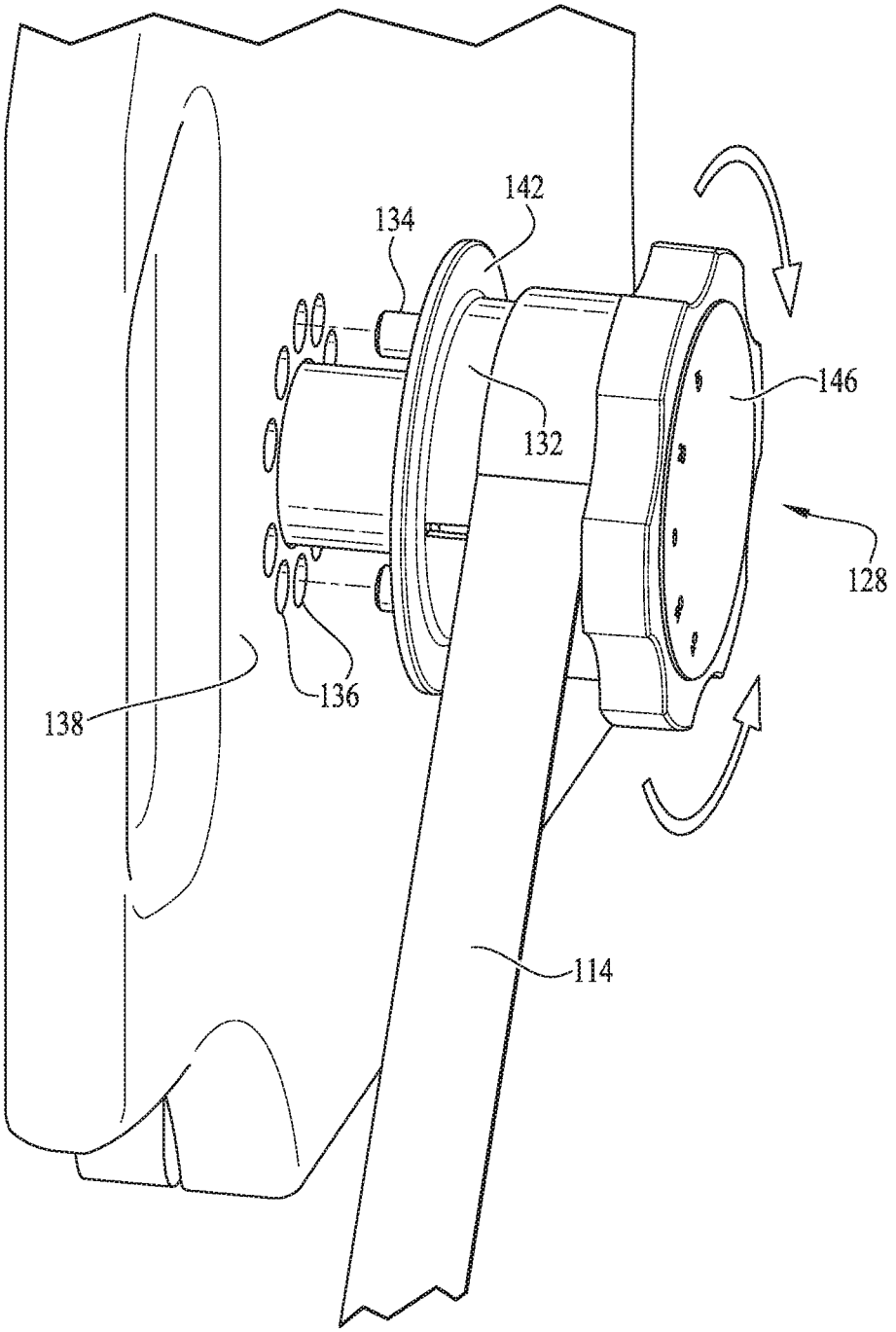
FIG. 6 is an enlarged view of an adjustment mechanism for altering a position of the anchor ledge of FIGS. 1-3.

With particular reference to FIGS. 4-6, the following provides additional details relating to the adjustment mechanisms 128, 130 of the shaft assembly 116 (or the shaft assembly 216). As illustrated in FIGS. 4-6, the first adjustment mechanism 128 includes a retaining cap 146 having a generally cylindrical gripping surface that may be notched, fluted, knurled, or otherwise textured to provide a surface for the swimmer to grip easily when manually handling and/or rotating the adjustment mechanism 128. The first adjustment mechanism 128 further includes a spooling track or guideway 132 formed between the retaining cap 146 and an end 142 of the first adjustment mechanism 128, where the line 114 is coupled to the first adjustment mechanism 128 via the guideway 132. As further described in detail below, when the first adjustment mechanism 128 is rotated to adjust the position of the anchor ledge 112, the strap 114 spools onto (or spools away from) the spooling track 132. It should be understood that the second adjustment mechanism 130 also includes a similar arrangement with a track or guideway used to spool the line 114 during adjustments.

With reference to FIGS. 5 and 6, the first adjustment mechanism 128 further includes one or more engagement members 134 (such as dowels, pins, tabs, or other suitable features) extending outwardly from an edge face (not shown) of the end 142 of the first adjustment mechanism 128. In some embodiments, the engagement members 134 may be formed as integral components of the first adjustment mechanism 128. In other embodiments, the engagement members 134 may instead be formed as standalone components coupled to or otherwise affixed to the adjustment mechanism 128. Preferably, the second adjustment mechanism 130 does not include such engagement members coupled thereto.

The engagement members 134 are sized and dimensioned to key the adjustment mechanism 128 to corresponding openings 136 formed along the first side panel 138 of the base 102 of the standing platform 100. In operation, the engagement members 134 and openings 136 cooperate with one another to facilitate gross adjustments of the position of the anchor ledge 112. As further described in detail below, the first adjustment mechanism 128 may be pulled away from the first side panel 138 and rotated to draw in the line 114, thereby adjusting the position of the anchor ledge 112. In some embodiments, the engagement members 134 and openings 136 may allow for vertical adjustments (either upwardly or downwardly) of the anchor ledge 112 in 20 millimeter increments. In such embodiments, the base 102 may accommodate a total travel of ±40 mm in either an upward direction (e.g., toward the tread surface 104 of the starting platform 100) or a downward direction (e.g., away from the tread surface 104 and toward the water surface). It should be understood that in other embodiments, the openings 136 may be formed at various height positions to accommodate adjustments at a larger or smaller scale than the example provided without departing from the principles of the disclosed subject matter.

With collective reference to FIGS. 1-6, the following provides additional details of the starting platform 100, and provides an example method for adjusting a position of the anchor ledge 112 of the starting platform 100. In an example adjustment operation, a swimmer may be in the pool and determine that the height of the anchor ledge 112 is unsuitable or uncomfortable for a particular backstroke swimmer. Accordingly, the swimmer may reach out of the pool and grasp the first adjustment mechanism 128. To adjust the height of the anchor ledge 112, the first adjustment mechanism 128 is pulled axially along a horizontal axis H of the shaft 118 (see FIG. 3) to pull the first adjustment mechanism 128 away from the side panel 138. In some embodiments, the first adjustment mechanism 128 may be pulled away from the side panel 138 by up to 0.5 inches to disengage the engagement members 134 from the openings 136 formed on the side panel 138. It should be understood that in other embodiments, the first adjustment mechanism 128 may be pulled to a larger distance (e.g., 1-2 inches) or to a smaller distance (e.g., less than 0.5 inches) as suitable for a particular design of the starting platform 100. With reference to FIG. 2, the second side panel 140 includes a recessed bore 144 having a depth that at least matches the axial travel distance of the first adjustment mechanism 128. For example, if the first adjustment mechanism 128 is pulled away by up to 0.5 inches to disengage the engagement members 134, the recessed bore 144 on the second side panel 140 may have a depth of at least 0.5 inches to accommodate inward movement of the second adjustment mechanism 130 along the axis H as the first adjustment mechanism 128 is moved axially.

Once the first adjustment mechanism 128 has been pulled away from the side panel 138 to disengage the engagement members 134, the first adjustment mechanism 128 is rotated in either a clockwise or counterclockwise direction to affect a desired adjustment. In the example embodiment illustrated in the figures, the first adjustment mechanism 128 may be rotated in a counterclockwise direction to reposition the engagement members 134 adjacent to an adjoining opening 136 on the side panel 138. This counterclockwise rotation of the first adjustment mechanism 128 draws up a portion of the line 114 into the spool track 132, thereby shortening the overall length of the line 114 and moving the anchor ledge 112 upwardly toward the tread surface 104. Rotation of the first adjustment mechanism 128 urges rotation of both the shaft 118 (or the shaft 218) and the second adjustment mechanism 130, thereby evenly drawing up the line 114 and balancing the anchor ledge 112. Similarly, the first adjustment mechanism 128 may be rotated in a clockwise direction to reposition the engagement member 134 adjacent to a different opening 136. This clockwise rotation releases a portion of the line 114 from the spool track 132 to move the anchor ledge 112 downwardly away from the tread surface 104.

Once the desired position for the anchor ledge 112 has been determined for the swimmer, the first adjustment mechanism 128 is released. Upon release of the first adjustment mechanism 128, the compression spring 120 (or spring 220) of the shaft assembly 116 (or the shaft assembly 216) draws the engagement members 134 of the first adjustment mechanism 128 back against the side panel 138 to secure the engagement members 134 within the selected opening 136. Once the first adjustment mechanism 128 is secured against the side panel 138, the new height of the anchor ledge 112 is established. If further adjustments are necessary, the process may be repeated as needed until an appropriate final position for the anchor ledge 112 is found.

It is intended that subject matter disclosed in any one portion herein can be combined with the subject matter of one or more other portions herein as long as such combinations are not mutually exclusive or inoperable. In addition, many variations, enhancements and modifications of the concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. A starting platform for swimmers comprising:

a base having a platform with an anti-slip tread surface sized and dimensioned to support a swimmer walking thereon, a first side panel and an opposite second side panel spaced apart from the first side panel, the base further including an interior cavity between the first side panel and the second side panel, and underneath the platform; and an adjustable anchor ledge assembly fixedly coupled to the base, the anchor ledge assembly further comprising:

a shaft extending along a horizontal axis from the first side panel to the second side panel of the base, a portion of the shaft disposed within the interior cavity of the base;

a first adjustment mechanism on a first end of the shaft, the first adjustment mechanism disposed along the first side panel of the base; and anchor ledge extending downwardly relative to the base, the anchor ledge operatively coupled to the first adjustment mechanism, wherein the first adjustment mechanism is actuatable to rotate the shaft along a rotational axis thereof and adjust a position of the anchor ledge relative to the base.

2. The starting platform of claim 1, wherein the first adjustment mechanism is movable axially along the horizontal axis of the shaft to an adjustment position whereat the first adjustment mechanism is offset from the first side panel of the base, and wherein the first adjustment mechanism is rotatable about the horizontal axis when in the adjustment position to adjust the position of the anchor ledge relative to the base.

3. The starting platform of claim 2, wherein the second side panel includes a recessed bore formed thereon, the starting platform further including a second adjustment mechanism positioned along a second end of the shaft, the second adjustment mechanism moving axially along the horizontal axis toward the recessed bore when the first adjustment mechanism is moved to the adjustment position.

4. The starting platform of claim 3, the anchor ledge assembly further comprising:

a first line coupled to the first adjustment mechanism and the anchor ledge; and a second line coupled to the second adjustment mechanism and the anchor ledge, wherein rotation of the first adjustment mechanism adjusts a length of the first line and simultaneously rotates the shaft and the second adjustment mechanism to concurrently adjust a length of the second line, thereby adjusting the position of the anchor ledge.

5. The starting platform of claim 2, wherein the first adjustment mechanism includes at least one engagement member, wherein the first side panel includes a plurality of openings formed thereon, each of the openings sized and dimensioned to receive the at least one engagement member, and wherein the first adjustment mechanism is removably coupled to the first side panel of the base via the at least one engagement member.

6. The starting platform of claim 1, wherein the shaft further includes a biasing member arranged to urge the first adjustment mechanism against the first side panel.

7. The starting platform of claim 6, wherein the first adjustment mechanism is movable axially along the horizontal axis of the shaft to an adjustment position whereat the first adjustment mechanism is offset from the first side panel of the base, and wherein the first adjustment mechanism is rotatable about the horizontal axis when in the adjustment position to adjust the position of the anchor ledge relative to the base, and wherein the biasing member automatically returns the first adjustment mechanism from the adjustment position to a fixed position whereat the first adjustment mechanism is adjacent the first side panel.

8. The starting platform of claim 6, further comprising a tube surrounding the shaft and the biasing member, the tube positioned within the interior cavity of the base.

9. The starting platform of claim 1, wherein the anchor ledge assembly includes a first line coupling the anchor ledge to the first adjustment mechanism, wherein a length of the first line is adjustable via rotation of the first adjustment mechanism to adjust the position of the anchor ledge.

10. The starting platform of claim 9, wherein the first adjustment mechanism includes a track, and wherein the first line is spooled on the track when the position of the anchor ledge is adjusted.

11. The starting platform of claim 9, wherein the anchor ledge assembly includes a second line coupling the anchor ledge to a second adjustment mechanism, wherein rotation of the first adjustment mechanism urges rotation of the second adjustment mechanism via the shaft, and wherein a length of the second line is adjusted as the second adjustment mechanism rotates.

12. The starting platform of claim 1, wherein the anchor ledge is wedge-shaped.

13. The starting platform of claim 1, further comprising one or more handgrips formed on the base.

14. A method for adjusting an anchor ledge of a starting platform, the starting platform including a base having a platform with an anti-slip tread surface sized and dimensioned to support a swimmer walking thereon, and a shaft extending along a horizontal axis and fixedly coupled to the base and positioned beneath the anti-slip tread surface within a cavity of the starting platform, the shaft operatively coupled to the anchor ledge, and a first adjustment mechanism coupled to the shaft and the anchor ledge, the method comprising:

grasping the first adjustment mechanism when at a fixed position adjacent a first side panel of the starting platform;

moving the first adjustment mechanism axially away from the base of the starting platform along the horizontal axis of the shaft; and rotating the first adjustment mechanism to rotate the shaft about the horizontal axis and adjust a position of the anchor ledge relative to the base.

15. The method of claim 14, wherein the starting platform further includes a second side panel opposite the first side panel, the second side panel including a recessed bore formed thereon, wherein the starting platform further includes a second adjustment mechanism positioned adjacent the second side panel, and wherein the second adjustment mechanism concurrently moves axially toward the recessed bore in response to moving the first adjustment mechanism along the horizontal axis of the shaft.

16. The method of claim 15, further including a first line coupled to the first adjustment mechanism and the anchor ledge, and a second line coupled to the second adjustment mechanism and the anchor ledge, wherein rotating the first adjustment mechanism adjusts a length of the first line and simultaneously rotates the shaft and the second adjustment mechanism to concurrently adjust a length of the second line, thereby adjusting the position of the anchor ledge.

17. The method of claim 14, further comprising releasing the first adjustment mechanism after the rotating step, wherein the first adjustment mechanism automatically returns to the fixed position upon release.

18. The method of claim 14, the first adjustment mechanism including at least one engagement member, and wherein the first side panel further includes a plurality of openings formed thereon, each of the openings sized and dimensioned to receive the at least one engagement member, the method further including engaging the at least one engagement member with a corresponding opening after the rotating step.

19. A starting platform for swimmers comprising:

a base having a top surface, a first side panel and an opposite second side panel spaced apart from the first side panel, the second side panel including a recessed bore formed thereon, the base further including an interior cavity disposed between the top surface, the first side panel, and the second side panel;

a shaft extending along a horizontal axis from the first side panel to the second side panel of the base, a portion of the shaft disposed within the interior cavity of the base;

a first adjustment mechanism coupled to a first end of the shaft, the first adjustment mechanism adjacent the first side panel of the base, wherein the first adjustment mechanism is movable axially along the horizontal axis of the shaft to an adjustment position whereat the first adjustment mechanism is offset from the first side panel of the base;

a second adjustment mechanism coupled to a second end of the shaft, the second adjustment mechanism adjacent the second side panel of the base, the second adjustment mechanism being movable axially along the horizontal axis toward the recessed bore when the first adjustment mechanism is moved to the adjustment position; and an anchor ledge extending downwardly relative to the base, the anchor ledge operatively coupled to the first adjustment mechanism, wherein the first adjustment mechanism is actuatable to rotate the shaft along a rotational axis thereof and adjust a position of the anchor ledge relative to the base.

20. The starting platform of claim 19, wherein the anchor ledge assembly includes a first line coupling the anchor ledge to the first adjustment mechanism, wherein a length of the first line is adjustable via rotation of the first adjustment mechanism to adjust the position of the anchor ledge, and wherein the anchor ledge assembly includes a second line coupling the anchor ledge to the second adjustment mechanism, wherein rotation of the first adjustment mechanism urges rotation of the second adjustment mechanism via the shaft, and wherein a length of the second line is adjusted as the second adjustment mechanism rotates.

* * * * *